US007292820B2

(12) United States Patent
Triplett et al.

(10) Patent No.: US 7,292,820 B2
(45) Date of Patent: Nov. 6, 2007

(54) INTEGRATED MEDIA INPUT TRAY INCLUDING ELECTRONICS

(75) Inventors: Edward Lynn Triplett, Lexington, KY (US); Larry Steven Foster, Lexington, KY (US); David Erwin Rennick, Georgetown, KY (US); Daniel L. Carter, Georgetown, KY (US); Richard G. Boyatt, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 713 days.

(21) Appl. No.: 10/630,045

(22) Filed: Jul. 30, 2003

(65) Prior Publication Data

US 2005/0035523 A1 Feb. 17, 2005

(51) Int. Cl.
*G03G 15/00* (2006.01)

(52) U.S. Cl. ..... 399/393; 399/391

(58) Field of Classification Search ..... 399/393, 399/391

See application file for complete search history.

(56) References Cited

U.S. PATENT DOCUMENTS

| | | | | |
|---|---|---|---|---|
| 4,017,181 | A * | 4/1977 | Komaba et al. | 355/72 |
| 4,456,235 | A | 6/1984 | Colglazier et al. | 271/3.08 |
| 4,580,890 | A | 4/1986 | Sugizaki et al. | 399/391 |
| 4,793,606 | A | 12/1988 | Yasuoka et al. | 271/157 |
| 4,872,659 | A | 10/1989 | Kato et al. | 271/9.01 |
| 5,005,820 | A | 4/1991 | Leemhuis | 271/127 |
| 5,008,715 | A | 4/1991 | Imaizumi et al. | 399/352 |
| 5,116,034 | A | 5/1992 | Trask et al. | 271/2 |
| 5,216,472 | A | 6/1993 | Muto et al. | 399/392 |
| 5,287,164 | A * | 2/1994 | Watanabe | 399/391 |
| 5,327,207 | A * | 7/1994 | Otake et al. | 399/364 |
| 5,346,197 | A * | 9/1994 | Takano et al. | 271/9.05 |
| 5,526,104 | A | 6/1996 | Kawano | 399/381 |
| RE35,341 | E | 10/1996 | Kikuchi et al. | 271/3.14 |
| 5,573,234 | A | 11/1996 | Petocchi | 271/9.01 |
| 5,758,249 | A * | 5/1998 | Dutton et al. | 399/391 |
| 5,790,933 | A | 8/1998 | Williams | 399/393 |
| 5,932,313 | A * | 8/1999 | Barton | 428/141 |
| 5,996,995 | A | 12/1999 | Kim et al. | 271/303 |
| 6,022,013 | A | 2/2000 | Foglino et al. | 271/9.08 |
| 6,148,172 | A | 11/2000 | Kanda et al. | 399/391 |
| 6,179,499 | B1 * | 1/2001 | Beretta et al. | 400/605 |
| 6,371,476 | B2 | 4/2002 | Isogai et al. | 271/3.14 |
| 6,438,351 | B2 | 8/2002 | Kawachi et al. | 399/394 |
| 2001/0052666 | A1 | 12/2001 | Kuwata et al. | |

* cited by examiner

*Primary Examiner*—Anthony H. Nguyen
(74) *Attorney, Agent, or Firm*—Coats & Bennett, PLLC

(57) ABSTRACT

A removable media tray for an image forming apparatus includes a housing, an exit port in the housing, a primary media stack, and a multi-purpose tray (MPT) input. Within the tray are first and second pick mechanisms operative to select a media sheet from the primary stack or MPT stack, respectively, and move the media sheet to the image forming apparatus through the exit port. A motor is disposed within the tray housing, and first and second drive assemblies operatively connect the motor to the first and second pick mechanisms, respectively. The motor drives the first pick mechanism forward by rotating in one direction, and drives the second pick mechanism forward by rotating in the opposite direction. A media sensor in the exit port senses media sheets from a variety of sources, including the primary media stack, the MPT stack, a duplex return path, or a large-capacity media sheet supply.

15 Claims, 3 Drawing Sheets

INTEGRATED MEDIA INPUT TRAY INCLUDING ELECTRONICS

BACKGROUND

The present invention relates generally to the field of image forming apparatuses and in particular to an image forming apparatus with an integrated media input tray including electronics.

Many image forming apparatuses; copiers; multi-function machines, i.e., those that combine two or more functions such as fax, scan, copy, and print; and the like (all of which are encompassed herein by the term "image forming apparatus"), contain one or more primary media trays that an end user removes from the machine to load with a stack of media sheets, such as print paper. The uppermost sheet in the stack is selected, or "picked" from the stack by the image forming apparatus. In some image forming apparatuses, one tray is inserted into a single receptacle in the image forming apparatus, the tray selected from a plurality of removable trays, each configured to hold different size and/or type of media sheets. Other image forming apparatuses accept a plurality of removable media input trays simultaneously into different receptacles.

In addition, many image forming apparatuses include a Multi-Purpose Tray (MPT), a separate media sheet input that is used to feed specialty media such as transparencies, envelopes, and the like. In some image forming apparatuses these specialty media are input manually, one media sheet at a time. Other image forming apparatuses pick specialty media from a small stack at an MPT input. In some image forming apparatuses, the MPT input is also removable from the image forming apparatus.

Traditionally each of these media input trays mates with a media sheet pick mechanism, such as for example an autocompensator, located in the base image forming apparatus. The pick mechanism operates to select and separate one media sheet (usually the uppermost sheet) from a stack of media sheets in the tray, and feed the selected sheet into the print mechanism in the image forming apparatus. The pick mechanism is driven by a motor, which is connected to the pick mechanism by a drive train. Both the motor and the drive train are traditionally located in the image forming apparatus.

Prior art removable media input trays also may include a variety of media sensors (and/or configurable surfaces operative to trigger sensors located in the image forming apparatus) that sense, for example, media size, media near empty, transparency sensing, and media in the paper path. A large plurality of sensors, particularly if required on each of two or more removable media input trays, increases costs and reduces reliability by proliferating the number of potential failure points.

Conventional removable media input trays present several disadvantages. Because the pick mechanism, drive train, and motor are housed in the image forming apparatus, and media sheets are picked from a stack located in the tray, the drive force of the pick tire exerted on the media stack tend to push the tray out of the image forming apparatus. To combat this force, and avoid the media input tray being dislodged from the image forming apparatus, many removable media input trays include detents or other pliable surfaces that deform slightly upon insertion and removal of the tray from the image forming apparatus, thus "latching" the tray to the image forming apparatus when inserted. These securing mechanism add cost and complexity to the tray, make it more difficult to use by requiring greater force to insert or remove the tray, and decrease reliability as the pliable surfaces may break off from the tray in use.

In prior art image forming apparatuses including both a primary media input tray and an MPT input, the MPT input is typically located above the primary media input tray (to facilitate removal of the primary media tray). This necessarily increases the overall height of the image forming apparatus. In addition, if the same motor is used to drive pick mechanisms for both the primary media input tray and the MPT input, a complex drive train having a compliant member such as a swing arm clutch is required to break the drive train, such that the image forming apparatus can operate when one or the other of the primary media input tray and the MPT input are removed. Such a drive train adds cost and complexity to the image forming apparatus, and may further increase the undesirable dislodging force(s) exerted on the removable tray(s). Additionally, locating part of the paperfeed mechanism in the image forming apparatus and part in the removable tray increases the difficulty and cost of troubleshooting and servicing failed components.

SUMMARY

The present invention relates to an image forming apparatus having a removable media tray. The tray includes a housing, a media sheet exit port in the housing, a primary media stack area within the housing operative to receive and hold a primary stack of media sheets, and a multi-purpose tray (MPT) input in the housing operative to receive media sheets from an MPT stack of one or more sheets. Also within the tray housing are first and second pick mechanisms operative to select a media sheet from the primary stack or MPT stack, respectively, and move the media sheet to the image forming apparatus through the exit port. A motor is disposed within the tray housing, and first and second drive assemblies operatively connect the motor to the first and second pick mechanisms, respectively. By rotating in one direction the motor drives the first drive train forward and drives the second drive train in reverse, and vise versa by rotating in the other direction. The pick mechanisms actuated by the respective drive trains are constrained to forward rotation by one-way clutch mechanisms. A media sensor in the exit port senses media sheets from a variety of sources, including the primary media stack, the MPT stack, a duplex return path, or a large-capacity media sheet supply. The size of media sheets in the primary media stack may be determined when the tray is inserted into the image forming apparatus by picking a sheet, and measuring the length of the sheet from the duration the sheet is disposed in the exit port via the sensor. The size of the media sheet may then be determined from its length.

DETAILED DESCRIPTION OF THE INVENTION

Figure 1:
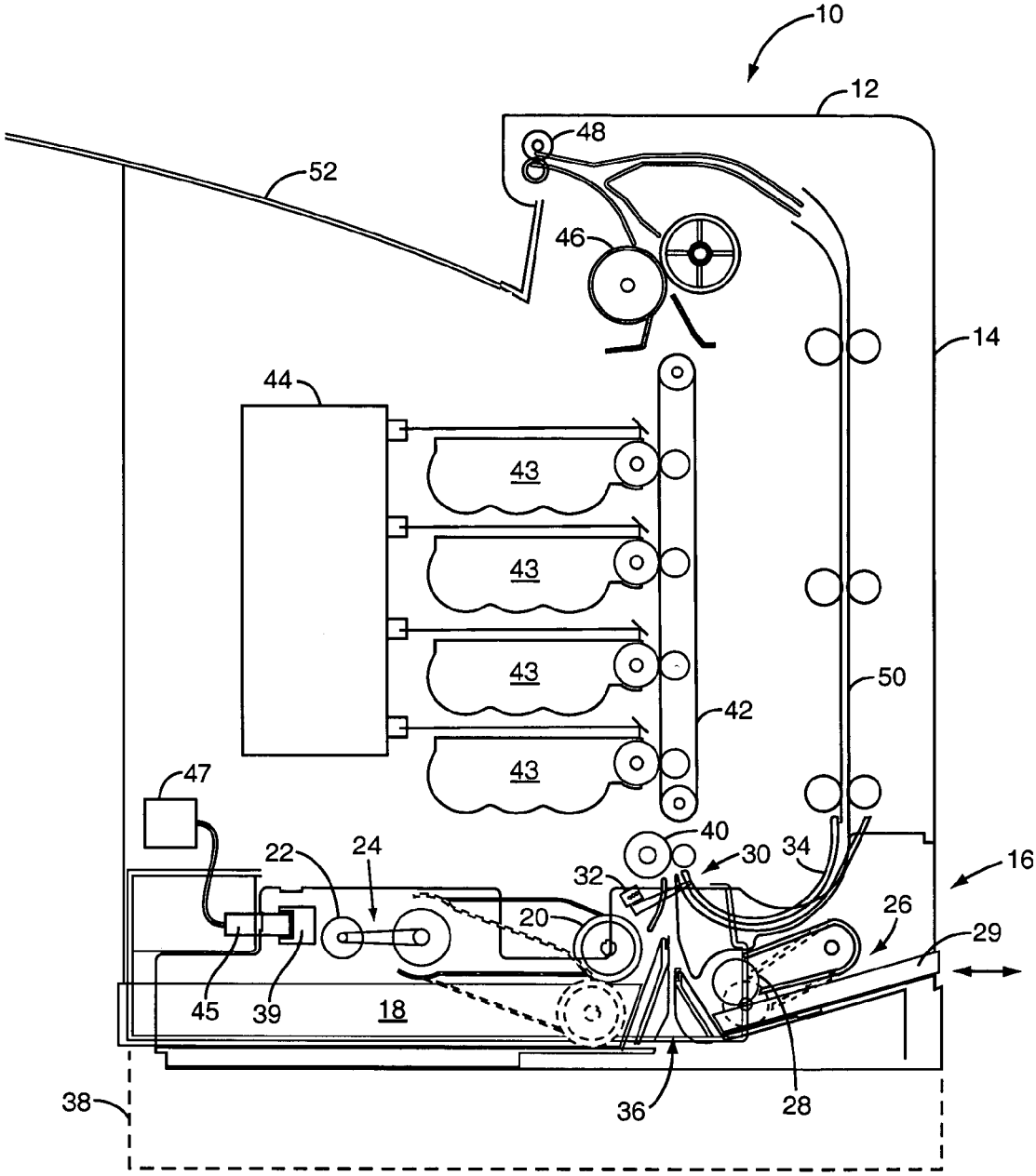
FIG. 1 is sectional functional block diagram of one embodiment of an image forming apparatus.

FIG. 1 depicts a representative image forming apparatus, indicated generally by the numeral 10. The image forming apparatus 10 comprises a body 12 having a front face 14 and a removable media input tray 16. The tray 16 may be removed from the image forming apparatus 10 by pulling it from the front 14 of the image forming apparatus body 12, as indicated by arrows.

Figure 2:
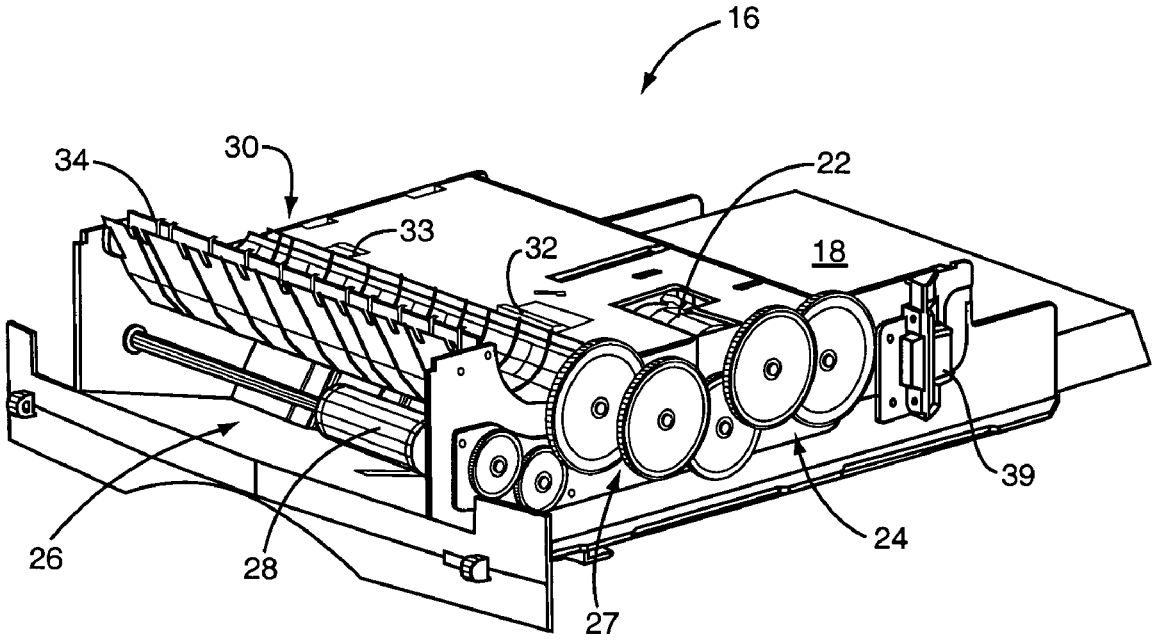
FIG. 2 is perspective view of one embodiment of a removable media input tray.
Figure 3:
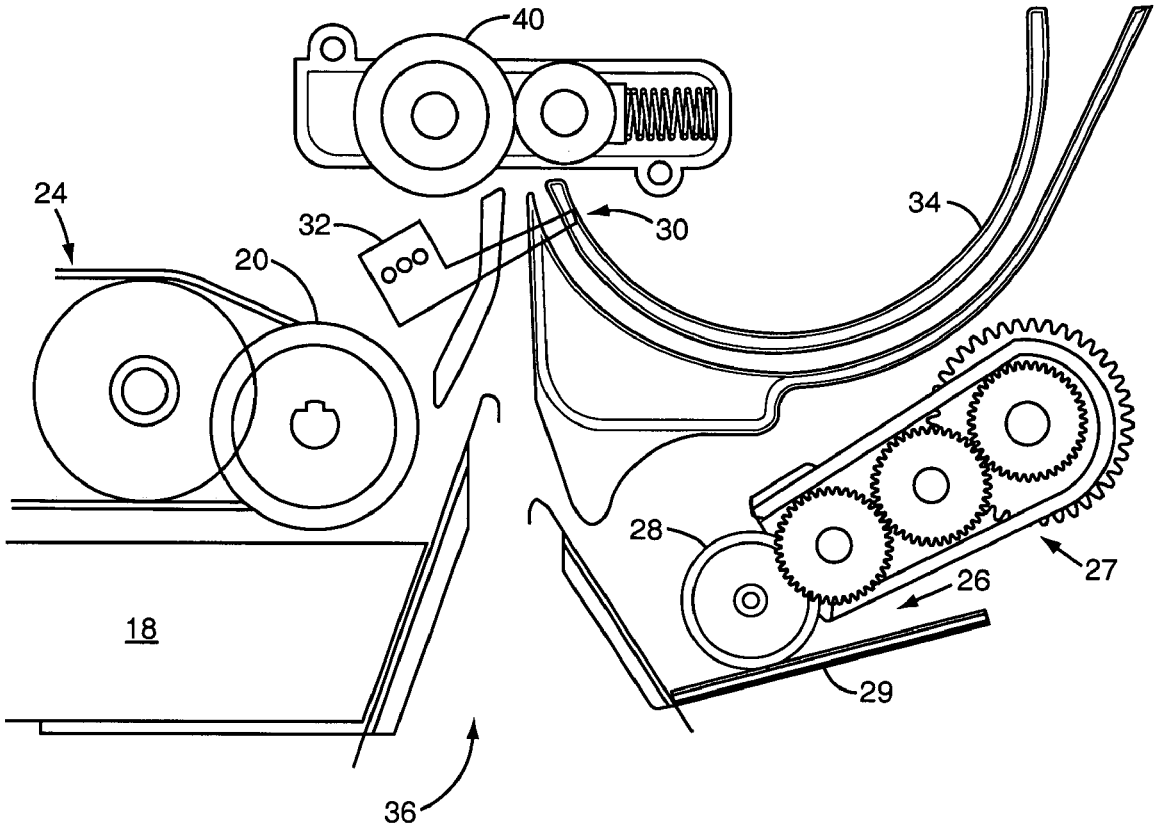
FIG. 3 is an enlarged sectional functional block diagram of part of a removable media input tray according to one embodiment of the present invention.

As depicted in FIGS. 1, 2, and 3, the removable media input tray 16 includes a primary stack of media sheets 18, a primary pick mechanism 20, a motor 22, and a first drive train 24 operatively connecting the motor 22 to the primary pick mechanism 20. The primary pick mechanism 20 is operative to select the uppermost single media sheet from the primary stack 18, and transfer it to an exit port 30. The dotted-line depictions of the pick mechanisms 20 and 28 in FIG. 1 show the movement of the mechanisms as media sheets are fed from the underlying stacks 18 and 29. The tray 16 additionally includes a multi-purpose tray (MPT) input 26, and a MPT pick mechanism 28 operatively driven by the motor 22 via a second drive train 27 (see FIG. 3). The MPT pick mechanism 28 is operative to select the uppermost single media sheet from an MPT stack 29, which may comprise one or more media sheets, and transfer it to the exit port 30.

In one embodiment, when the motor 22 is driven in a first direction, it actuates the first drive train 24 and hence the primary pick mechanism 20 in a "forward" direction to pick a media sheet from the stack 18. At the same time, the second drive train 27 is driven in a "reverse" direction; however, the MPT pick mechanism 28 is prevented from turning due to a one-way clutch mechanism within the MPT pick mechanism 28. Similarly, when the motor 22 is driven in the opposite direction, the second drive train 27 and hence the MPT pick mechanism 28 are driven in a "forward" direction to pick a media sheet from the stack 29. Meanwhile, the first drive train 24 is driven in a "reverse" direction; however, the primary pick mechanism 20 is prevented from turning due to a one-way clutch mechanism within the primary pick mechanism 20. In this manner, the motor 22 drives both drive trains 24, 27, and pick mechanisms 20, 28 are constrained to only pick paper from their respective stacks 18, 29 and feed it into the image forming apparatus 10.

Power to drive the motor 22 is supplied through a connector 39 connected to the tray 16, which mates, upon insertion of the tray 16 into the image forming apparatus 10, to a corresponding connector 45 mounted in the image forming apparatus body 12. The connector 45 is electrically connected to a power supply 47, also mounted within the image forming apparatus body 12.

The removable media input tray 16 includes a duplex path media sheet guide 34 operative to direct media sheets from a duplex path 50 in the image forming apparatus 10 to the exit port 30. In addition, the removable media input tray 16 includes an inlet port 36 that communicates directly to the exit port 30, allowing media sheets entering the inlet port 36 to travel into and through the exit port 30. The image forming apparatus 10 may optionally include a large-capacity media sheet supply 38 (see FIG. 1), which holds large quantities (for example, counts on the order of 500) of media sheets. The large-capacity supply 38 includes its own motor, drive train, sensors, and pick mechanism (not shown), and is operative to selectively deliver media sheets into the inlet port 36.

As most clearly depicted in FIG. 3, the removable media input tray 16 includes a primary media sheet sensor 32 disposed in the exit port 30 and operative to sense the presence of media sheets therein. One of skill in the art will recognize that the exit port 30 is designed and positioned so as to accept media sheets from any of four sources: the primary media stack 18, the MPT input 26, the duplex path guide 34, or the inlet port 36 (accepting sheets from the large-capacity supply 38). The exit port 30 guides media sheets from any of these four sources to the nip of registration roller 40, positioned within the image forming apparatus body 12.

As depicted in FIG. 2, the connector 39 is attached to the removable media input tray 16. Connector 39 is preferably a multi-conductor, self-aligning connector that mates with corresponding connector 45 positioned within the image forming apparatus body 12 when the removable media input tray 16 is fully inserted therein (see FIG. 1). Connector 39 conducts electrical power from the power supply 47 within the image forming apparatus body 12 to the motor 22 and associated electronics (not shown), as well as the sensor 32. The connector 39 also transfers the output of sensor 32 to control electronics (not shown) in the image forming apparatus body 12. In one embodiment, the mating of the connector 39 with its corresponding connector 45 in the image forming apparatus body 12 provides an indication to the image forming apparatus control electronics that the removable media input tray 16 has been inserted into the image forming apparatus body 12.

Referring to FIG. 1, within the image forming apparatus body 12, the image forming apparatus 10 includes, in addition to the registration roller 40, a media sheet transfer belt 42, one or more toner cartridges 43, a printhead 44, a fuser 46, reversible exit rollers 48, and a duplex media sheet path 50, as well as various rollers, actuators, sensors, optics, and electronics (not shown) as are conventionally known in the image forming apparatus arts, and which are not further explicated herein.

The operation of image forming apparatus 10 is conventionally known. Upon command from control electronics, a single media sheet is "picked," or selected, from either the primary media stack 18, the MPT stack 29, or the large-capacity supply 38. Alternatively, a media sheet may travel through the duplex path 50 and duplex path guide 34 for a two-sided print operation. The presence of the media sheet in the exit port 30 is sensed by a primary sensor 32, regardless of the source of the media sheet. A media width sensor 33, also located in the exit port 30 (see FIG. 2), may optionally additionally sense some media sheets therein.

Upon passing through the exit port 30 of the removable media sheet input tray 16 and into the image forming apparatus body 12, the media sheet is presented at the nip of a registration roller 40, which aligns the sheet and precisely controls its further movement into the print path. The media sheet passes the registration roller 40 and electrostatically adheres to transport belt 42, which carries the media sheet successively past at least one toner cartridge 43 (in the case of color printing, four toner cartridges 43 may each contain different colored toner, such as Cyan, Magenta, Yellow, and Black). At each toner cartridge 43, a latent image is formed by printhead 44 onto the respective photoconductive (PC) drum in each toner cartridge 43. Toner is applied to the PC drum, which is subsequently deposited on the media sheet as it is conveyed past the toner cartridge 43 by the transport belt 42. The toner is thermally fused to the media sheet by the fuser 46, and the sheet then passes through reversible exit rollers 48, to land facedown in the output stack 52 formed on the exterior of the image forming apparatus body 12. Alternatively, the exit rollers 48 may reverse motion after the trailing edge of the media sheet has passed the entrance to the duplex path 50, directing the media sheet through the duplex path 50 for the printing of another image on the back side thereof.

According to the present invention, as mentioned above, the sensor 32, positioned in the exit port 30, is operative to sense media sheets from a variety of sources. The sensor 32 may thus be advantageously employed to obviate the need for a plurality of media-related sensors common in removable media trays of the prior art. For example, in one embodiment, the image forming apparatus 10 automatically determines the size of sheet media in the primary media stack 18. Upon insertion of the removable media input tray 16 into the image forming apparatus body 12 (as detected by the mating of the connector 39 with its corresponding connector), an initial media sheet may be picked from the primary stack 18. The presence of the media sheet in the exit port 30 is detected by the primary sensor 32. By measuring the duration of time that the media sheet is in the exit port 30 and combining this information with the precise speed of the media sheet movement through registration roller 40, the image forming apparatus 10 can calculate the length of the media sheet. Based on this length, the image forming apparatus 10 may then determine the media size. In one embodiment, the media size determination may additionally be based on the output of a media width sensor 33. Based on the assumption that all media sheets in the primary media stack 18 are of the same size, the media size determination need be performed only once each time the removable media input tray 16 is inserted into the image forming apparatus body 12.

The removable media input tray 16 of the present invention present numerous advantages over removable media trays of the prior art. First, since the primary media stack 18 and MPT input 26 are largely co-planar (with respect to the paper path through the image forming apparatus 10), the height of the image forming apparatus body 12 may be reduced substantially, as compared to prior art image forming apparatuses where the MPT input is above the primary media tray. In one embodiment, the total height of the removable media input tray 16, from the bottom of the primary media stack 18 to the alignment roller 40, is approximately 85 mm. An additional advantage of placing the primary media stack 18 and MPT input 26 in the same part is that the reference features for the media may be precisely aligned. This leads to more accurate alignment of media sheets from each source, relative to the other, and may reduce the left margin variation caused by source-to-source errors, common in image forming apparatuses with separate primary media and MPT inputs.

Additionally, by locating the motor 22, drive trains 24, 27, and pick mechanisms 20, 28 within the tray 16, the forces generated and transferred by these elements are contained within the tray 16 as well. This reduces or eliminates the tendency of the removable tray 16 to become dislodged from its seated position within the image forming apparatus body 12 during use. Consequently, the biasing mechanisms used in prior art media trays to retain the tray 16 within the image forming apparatus body 12 may be eliminated, saving cost and increasing reliability.

Yet another advantage of locating the motor 22, drive trains 24, 27, and pick mechanisms 20, 28 within the tray 16 is the substantial cost savings from eliminating the need to provide a compliant member, such as a swing arm clutch, that would otherwise be required to break the drive trains when the tray 16 is removed from the image forming apparatus body 12. Additionally, drive train and pick mechanism support mechanisms, such as hanging brackets, are not required in the image forming apparatus body 12, further simplifying the image forming apparatus 10 design, and reducing cost and complexity.

Still another advantage of the present invention over the prior art relates to serviceability. Since all media sheet pick, feed, and sensing functions prior to the registration roller 40 are contained in the removable media input tray 16 (i.e., the motor 22, drive trains 24, 27, pick mechanisms 20, 28, and sensor 32), the tray 16 is a Customer Replaceable Unit (CRU). Any failure or anomalous operation of these components may be addressed by simply sending the customer a new tray 16. This eliminates the need for service calls to the customer's location by technicians, and dramatically reduces the down time of the unit, increasing perceived reliability and customer satisfaction.

As used herein, the term "image forming apparatus" includes any device that includes a print mechanism operative to fix text and/or images on media sheets. The term image forming apparatus includes all known technologies of computer image forming apparatuses, including electrophotographic, ink jet, dot matrix, thermal, sublimation, and the like, as well as all devices that include a print mechanism, such as traditional stand-alone image forming apparatuses, copiers, multi-function integrating scan, copy, print, fax, and similar operations, or the like. "Image forming apparatus" also applies to secondary transfer machines in which a toner image is formed by toner cartridges onto an intermediate member, which image is subsequently transferred to a media sheet, as well as the direct transfer mechanism depicted in FIG. 1. As used herein, the term "media sheet" refers to any medium on which images are formed by the image forming apparatus, and includes a wide range of sizes and types of paper sheets, as well as transparencies, envelopes, postcards, checks, iron-on transfers, and the like.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image forming apparatus, comprising:

a removable media tray, comprising;

a housing;

a media sheet exit port in said housing;

a primary media stack area within said housing operative to receive and hold a primary stack of media sheets;

a first pick mechanism within said housing operative to select a media sheet from said primary stack and move said media sheet to said exit port;

a pick mechanism drive assembly within said housing operative to actuate said first pick mechanism;

a multi-purpose tray (MPT) input on an exterior of the housing to receive and direct manually-fed media sheets to the exit port; and said removable media tray further comprising a duplex return path guide operative to receive a media sheet from a duplex return path in said image forming apparatus and direct said media sheet to said exit port.

2. The image forming apparatus of claim 1 wherein said pick mechanism drive assembly comprises:

a motor; and a first drive train operatively coupling said motor to said first pick mechanism.

3. The image forming apparatus of claim 1, said removable media tray further comprising a connector disposed so as to form electrical contact with a corresponding connector disposed within said image forming apparatus when said removable media tray is inserted in said image forming apparatus.

4. The image forming apparatus of claim 3 wherein said pick mechanism drive assembly receives electrical power through said connector when said removable media tray is inserted in said image forming apparatus.

5. The image forming apparatus of claim 4 wherein said connector aligns with said corresponding connector in said image forming apparatus.

6. The image forming apparatus of claim 2 further comprising a second pick mechanism operative to move said media sheet from said MPT input to said exit port.

7. The image forming apparatus of claim 6 wherein said pick mechanism drive assembly further comprises a second drive train operatively coupling said motor to said second pick mechanism.

8. The image forming apparatus of claim 7 wherein said motor drives said first drive train forward and said second drive train in reverse by rotating in one direction, and drives said second drive train forward and said first drive train in reverse by rotating in the opposite direction.

9. The image forming apparatus of claim 7 wherein said first and second pick mechanisms each include a one-way clutch that restricts motion of said pick mechanisms to the forward direction.

10. The image forming apparatus of claim 1 further comprising a large-capacity media sheet supply containing media sheets, and wherein said removable media tray further comprises a media sheet inlet port connected in media sheet flow relationship with said exit port, such that media sheets from said large-capacity media sheet supply pass through said removable media tray into said image forming apparatus via said exit port.

11. The image forming apparatus of claim 1 wherein said media sheet exit port includes a sensor operative to detect the presence of a media sheet.

12. An image forming apparatus, comprising:

a removable media tray, comprising;

a housing;

a media sheet exit port in said housing;

a primary media stack area within said housing operative to receive and hold a primary stack of media sheets; and a multi-purpose tray (MPT) input in said housing operative to receive media sheets from an MPT stack of one or more said sheets;

wherein media sheets selected from said primary stack and/or said MPT stack are directed to said image forming apparatus through said exit port;

a first pick mechanism within said housing operative to select a media sheet from said primary stack;

a second pick mechanism within said housing operative to select a media sheet from said MPT stack; and a pick mechanism drive assembly within said housing operative to actuate both said first and second pick mechanisms.

13. The image forming apparatus of claim 12 wherein said pick mechanism drive assembly comprises:

a motor;

a first drive train operatively coupling said motor to said first pick mechanism; and a second drive train operatively coupling said motor to said second pick mechanism.

14. The image forming apparatus of claim 13 wherein said motor drives said first drive train forward and said second drive train in reverse by rotating in one direction, and drives said second drive train forward and said first drive train in reverse by rotating in the opposite direction.

15. The image forming apparatus of claim 14 wherein said first and second pick mechanisms each include a one-way clutch that restricts motion of said pick mechanisms to the forward direction.

* * * * *